US009865115B2

(12) United States Patent
Kimura

(10) Patent No.: US 9,865,115 B2
(45) Date of Patent: Jan. 9, 2018

(54) COIN PROCESSING DEVICE

(71) Applicant: NIPPON CONLUX CO., LTD., Sakado-shi (JP)

(72) Inventor: Yasuyuki Kimura, Sakado (JP)

(73) Assignee: NIPPON CONLUX CO., LTD., Sakado-shi (JP)

( * ) Notice: Subject to any disclaimer, the term of this patent is extended or adjusted under 35 U.S.C. 154(b) by 0 days.

(21) Appl. No.: 15/511,325

(22) PCT Filed: Jun. 1, 2015

(86) PCT No.: PCT/JP2015/065814
§ 371 (c)(1),
(2) Date: Mar. 15, 2017

(87) PCT Pub. No.: WO2016/042851
PCT Pub. Date: Mar. 24, 2016

(65) Prior Publication Data

US 2017/0287251 A1 Oct. 5, 2017

(30) Foreign Application Priority Data

Sep. 16, 2014 (JP) ..... 2014-188047

(51) Int. Cl.
*G07D 5/08* (2006.01)
*G07D 5/02* (2006.01)
*G07D 5/00* (2006.01)

(52) U.S. Cl.
CPC ..... *G07D 5/02* (2013.01); *G07D 5/08* (2013.01); *G07F 3/025* (2013.01); *G07D 2205/00* (2013.01)

(58) Field of Classification Search
CPC .. G07D 5/00; G07D 5/02; G07D 5/08; G07D 2205/00; G07D 2205/001; G07F 3/025
See application file for complete search history.

(56) References Cited

U.S. PATENT DOCUMENTS 4,124,111 A * 11/1978 Hayashi ..... G07D 5/005 194/319
4,936,435 A * 6/1990 Griner ..... G07D 5/08 194/317

(Continued)

FOREIGN PATENT DOCUMENTS

JP 2008-146618 A 6/2008
JP 4126668 B2 7/2008

(Continued)

OTHER PUBLICATIONS

International Search Report issued Sep. 1, 2015 in PCT/JP2015/065814 filed Jun. 1, 2015, (3 pages).

*Primary Examiner* — Mark Beauchaine
(74) *Attorney, Agent, or Firm* — Oblon, McClelland, Maier & Neustadt, L.L.P.

(57) ABSTRACT

A coin processing device including: a material detection sensor including first and second coils facing each other with a coin passage interposed therebetween; an outer diameter detection sensor including ring-shaped third and fourth coils that surround the first and second coils, respectively; a first oscillation circuit connected to the material detection sensor that oscillates a first oscillation signal in an individual connection state and a series connected state and is connected to the material detection sensor and the outer diameter detection sensor; a second oscillation circuit connected to the outer diameter detection sensor that oscillates a second oscillation signal in the individual connection state; a switching unit that switches the individual connection state and the series connection state; a coin identification unit that detects an outer diameter of a coin using the second oscillation signal in the individual connection state or the first oscillation signal in the series connection state.

7 Claims, 14 Drawing Sheets

(56) References Cited

U.S. PATENT DOCUMENTS

| | | | | |
|---|---|---|---|---|
| 5,263,566 | A * | 11/1993 | Nara | G07D 5/02 194/318 |
| 5,988,348 | A | 11/1999 | Martin et al. | |
| 6,398,001 | B1 | 6/2002 | Hutchinson et al. | |
| 6,536,578 | B1 * | 3/2003 | Ashley | G07D 5/08 194/318 |
| 2009/0242354 | A1 * | 10/2009 | Miyauchi | G07D 5/08 194/317 |

FOREIGN PATENT DOCUMENTS

| | | | |
|---|---|---|---|
| JP | 2015-79425 | A | 4/2015 |
| WO | 98/00813 | A2 | 1/1998 |
| WO | 98/37522 | A1 | 8/1998 |

* cited by examiner

[Fig.1]
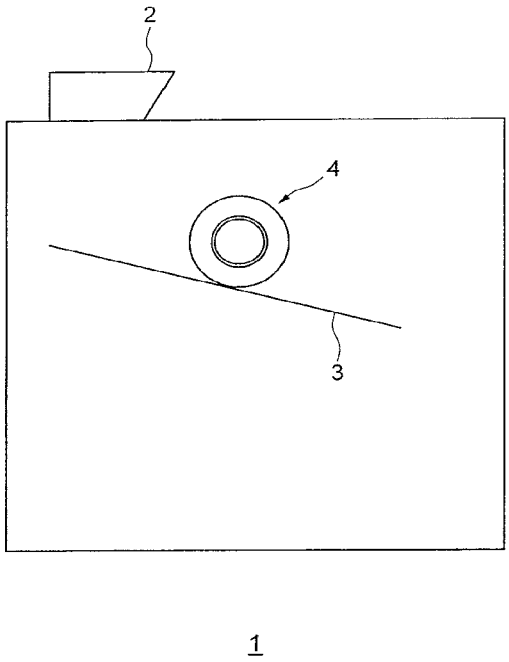

[Fig.2]
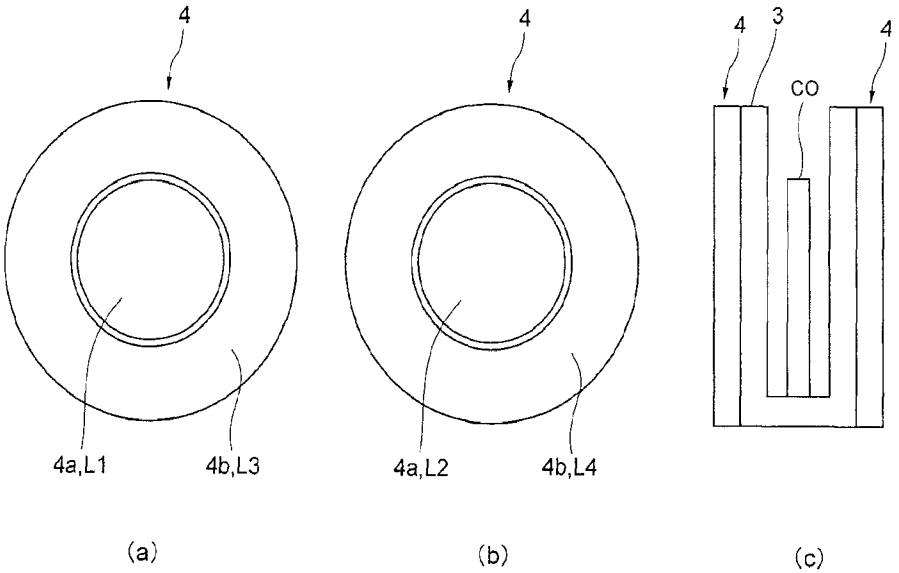

[Fig.3]
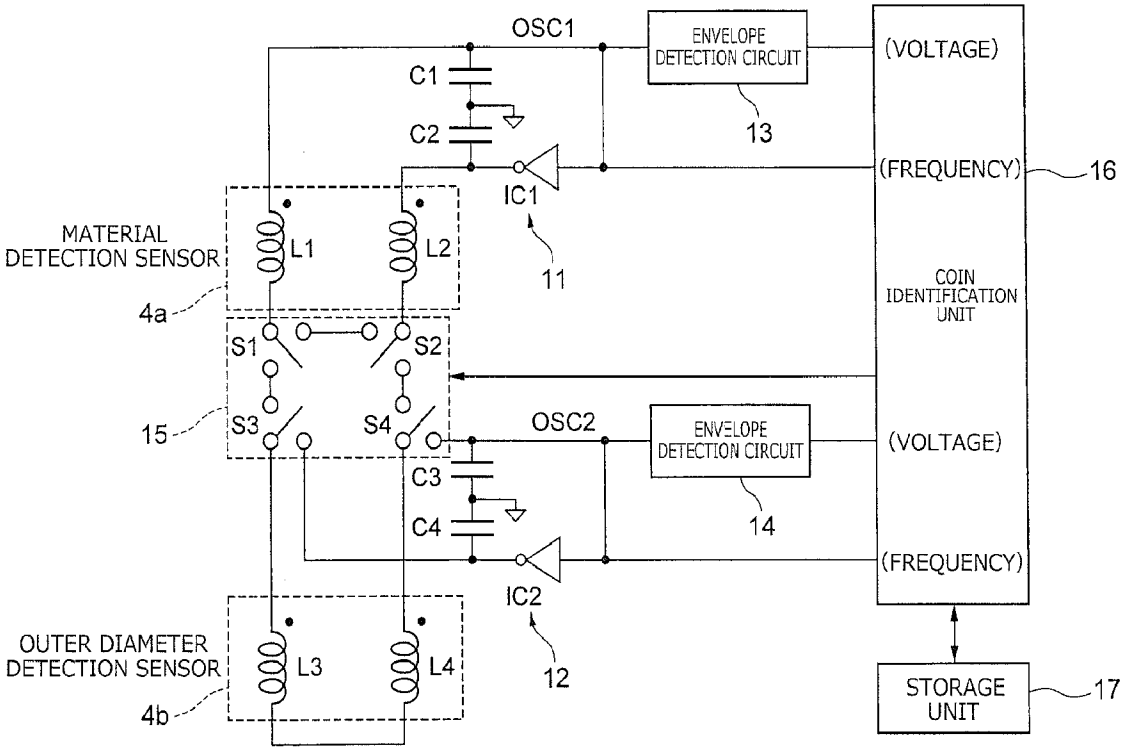

[Fig.4]
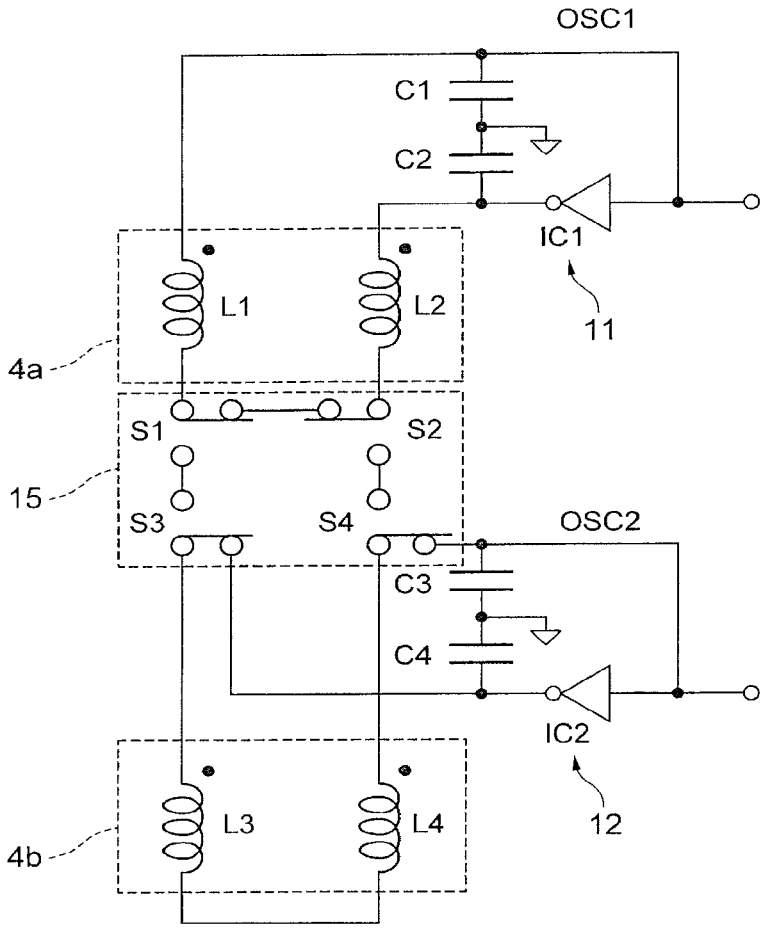

[Fig.5]
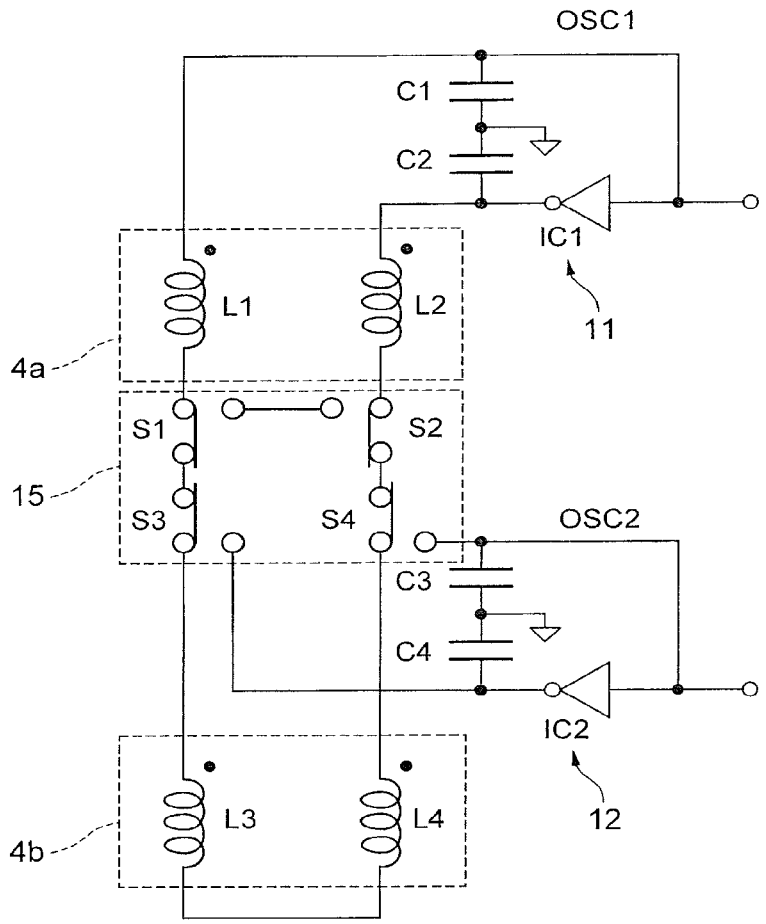

[Fig.6]
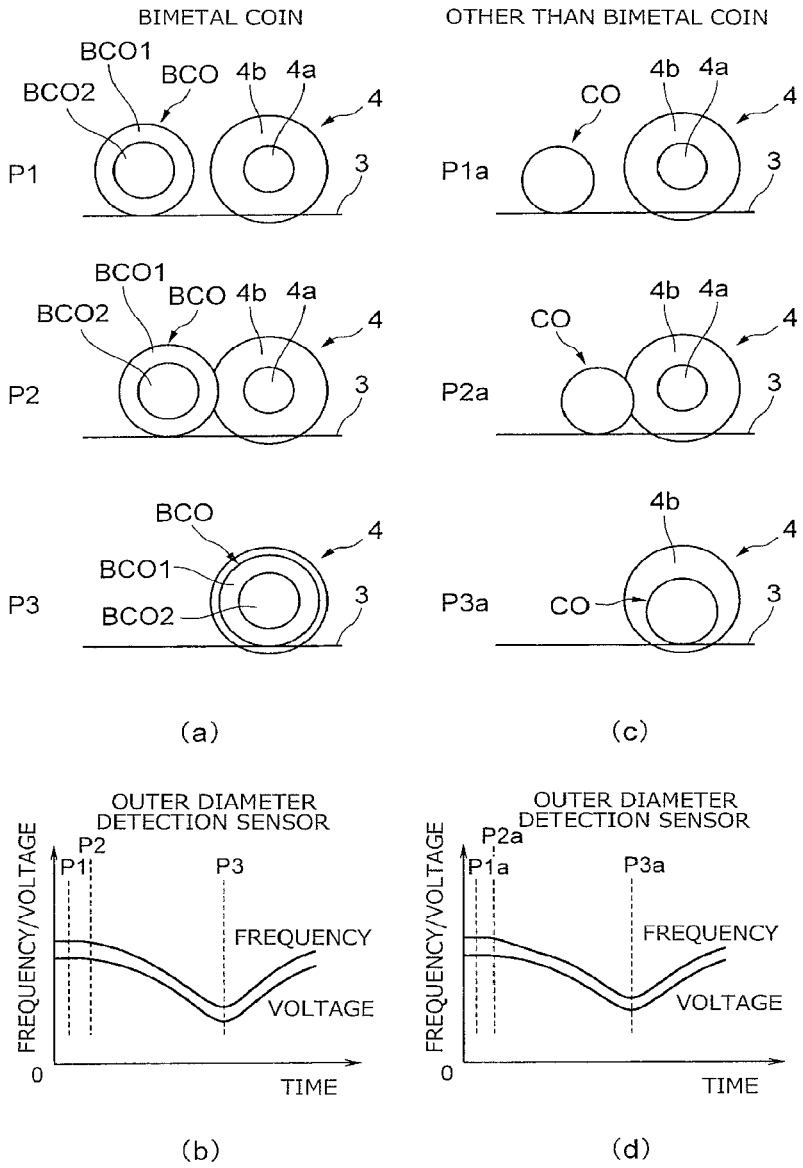

[Fig.7]
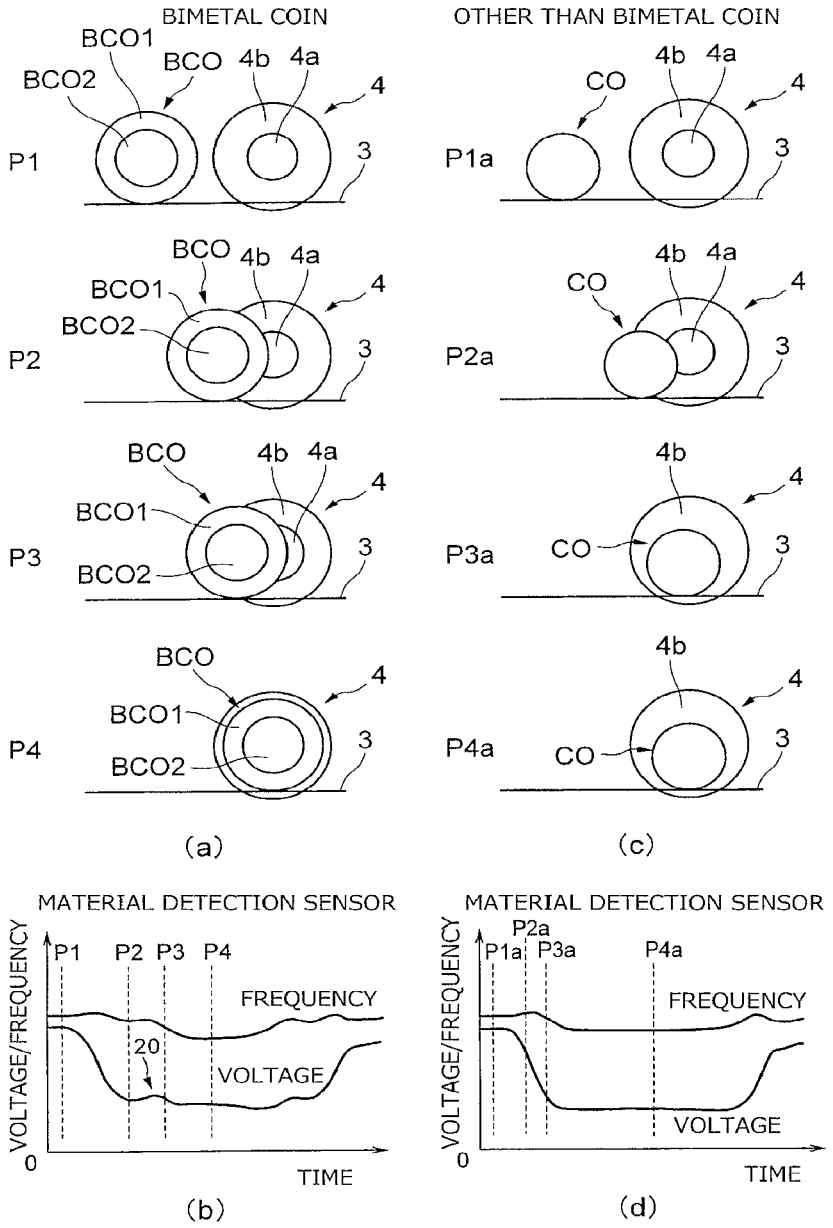

[Fig.8]
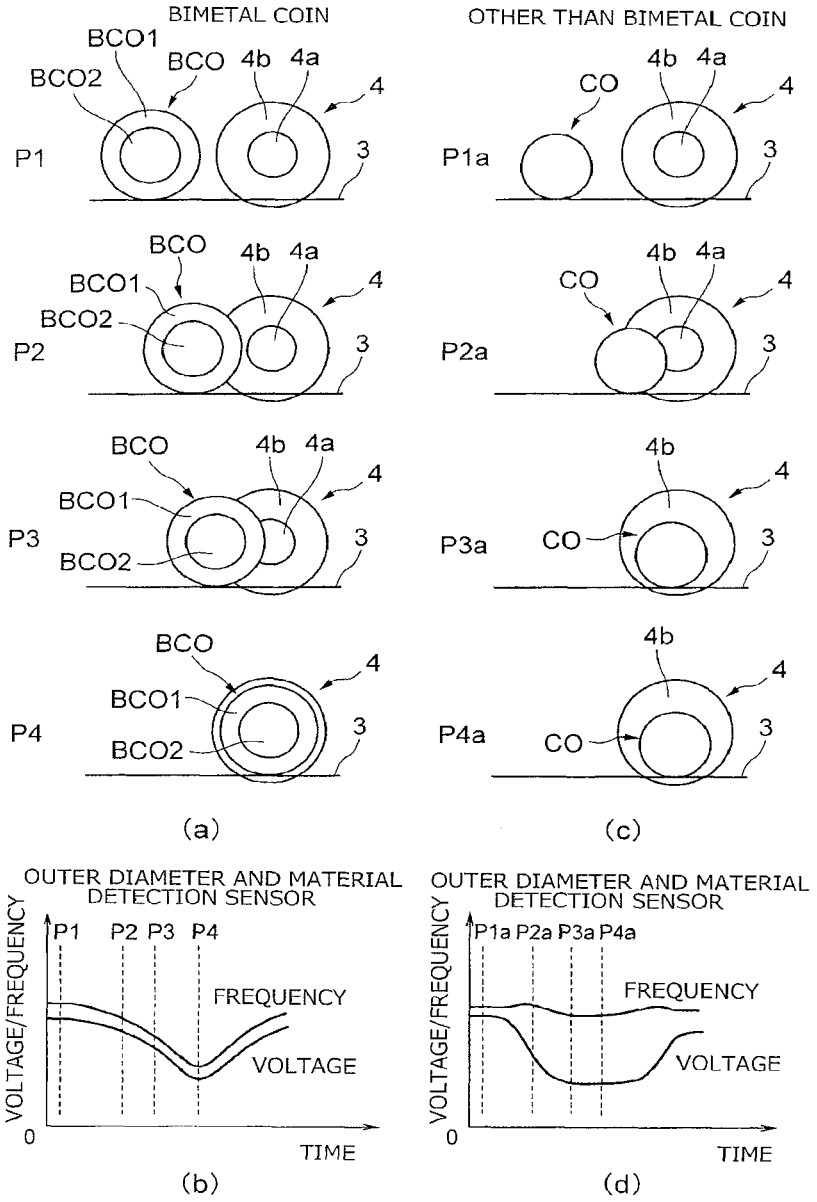

[Fig.9]
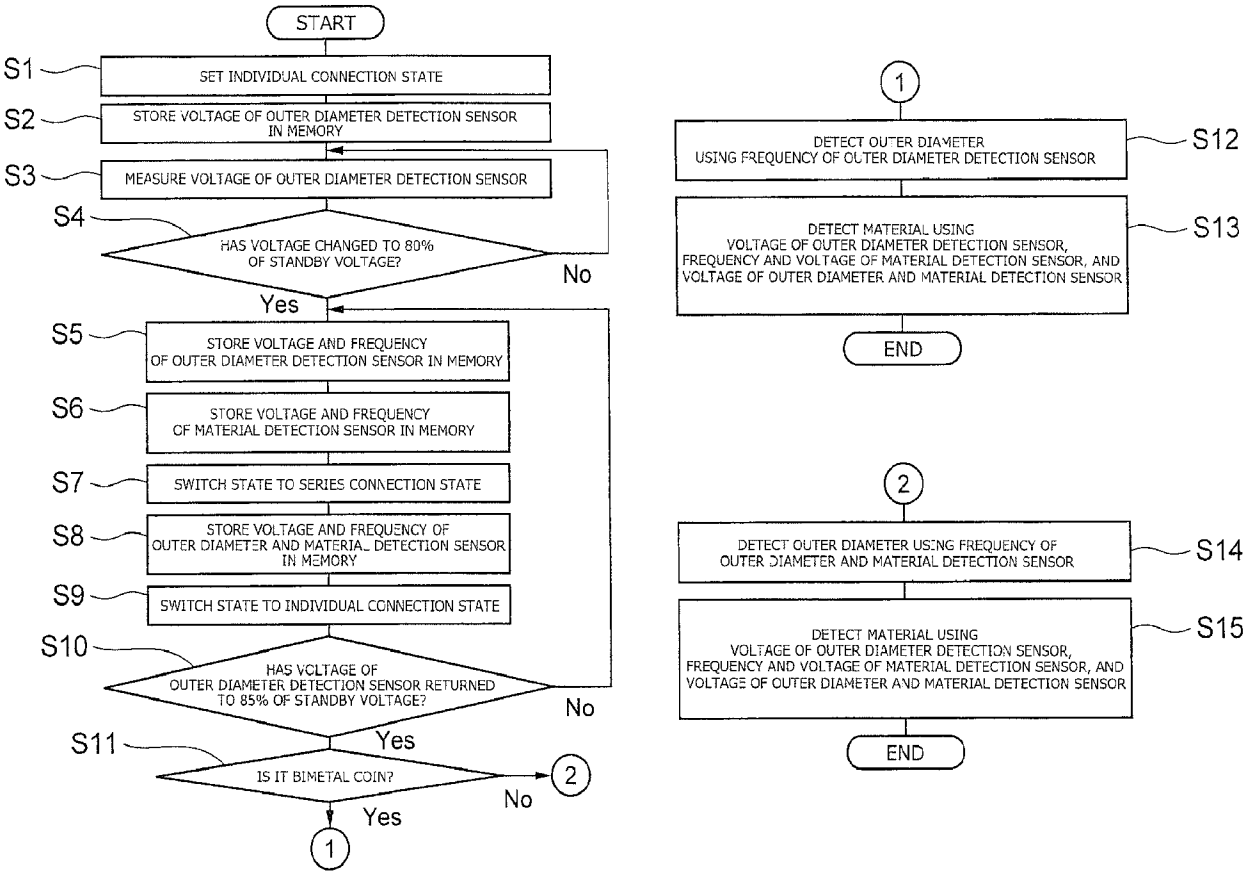

[Fig.10]
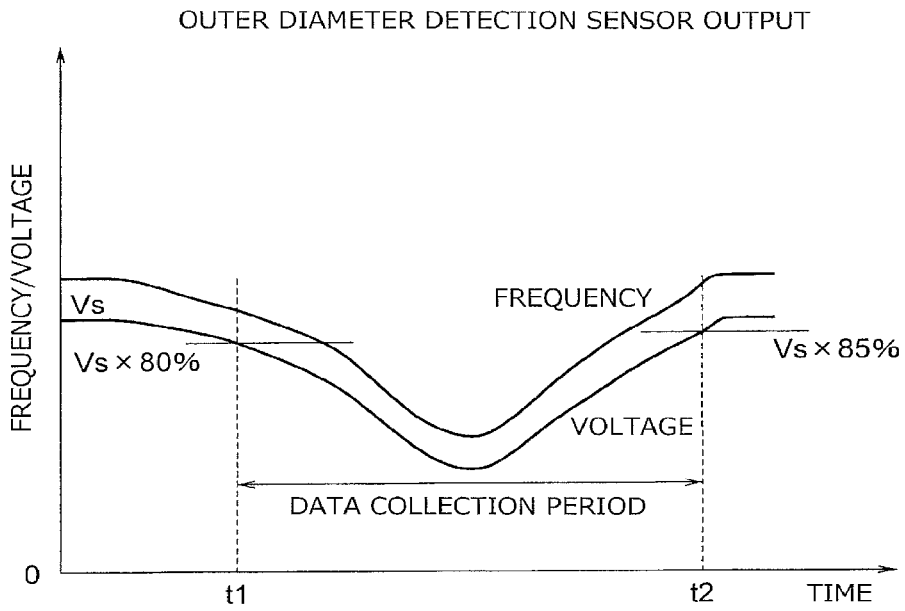

[Fig.11]
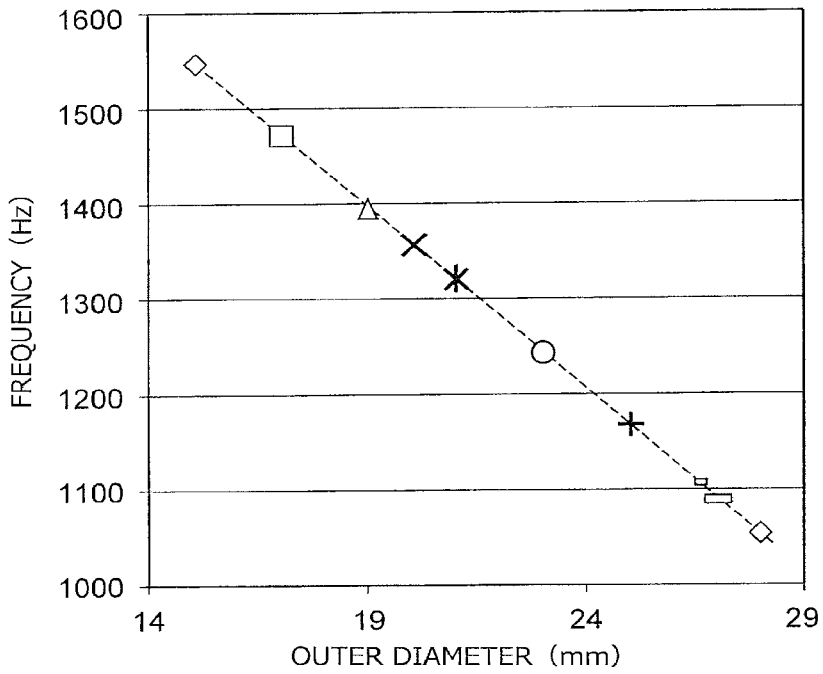

[Fig.12]
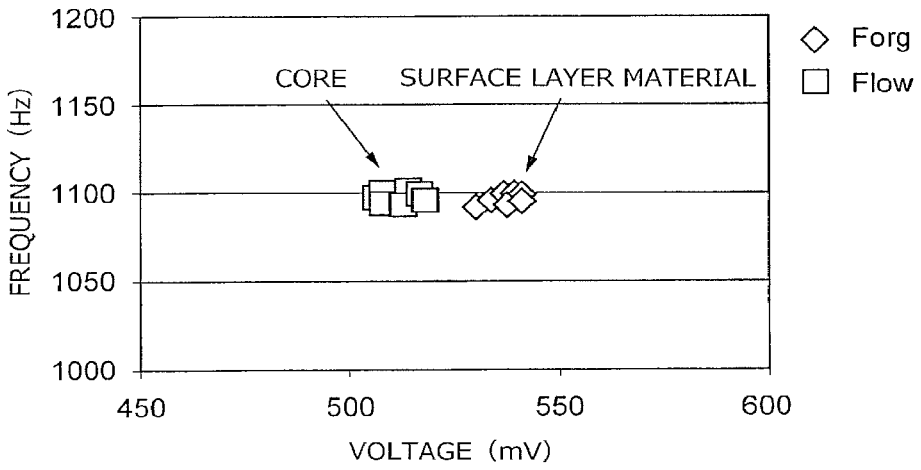

[Fig.13]
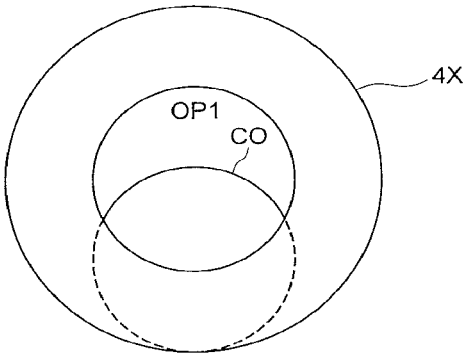

[Fig.14]
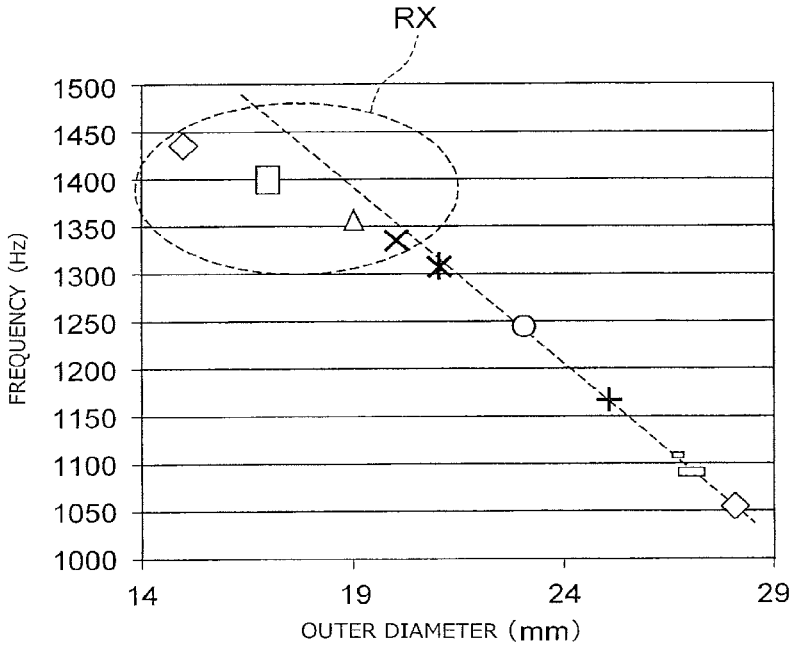

COIN PROCESSING DEVICE

TECHNICAL FIELD

The present invention relates to a coin processing device that is mounted to a vending machine, a money changer, a fare adjustment machine, a ticket-vending machine, or a servicing apparatus (hereinafter, referred to as a "vending machine or the like"), and particularly to a coin processing device provided with an outer diameter detection sensor that detects an outer diameter of a coin.

BACKGROUND ART

A coin processing device, which determines genuineness of inserted coins and sorts and stores coins determined as genuine coins for each denomination, is mounted inside a vending machine or the like. Such a coin processing device is provided with a coin sorting unit that determines the genuineness of the inserted coins and sorts out the coins for each denomination.

The coin sorting unit is provided with an outer diameter detection sensor that mainly detects an outer diameter of a coin and a material detection sensor that mainly detects a material of the coin. The outer diameter detection sensor includes a coil provided in a coin passage through which the inserted coin passes and is connected to an oscillation circuit. The material detection sensor is configured in the same manner. The oscillation circuit oscillates at an oscillation frequency depending on an inductance of the coil. This oscillation frequency is set to a frequency at which an electromagnetic field caused by oscillation is easily affected by the coin. As the electromagnetic field is affected by the coin, an amplitude of an oscillation signal also changes. Therefore, it is possible to detect the outer diameter and the material of the coin based on the oscillation frequency and the voltage. Accordingly, it is possible to perform genuineness determination and type determination of the coin.

Meanwhile, there is a coin processing device configured to determine genuineness of a plurality types of coins including a bimetal coin. The bimetal coin is a coin having different materials between a central core section and a ring section that surrounds the core section. For example, a two-dollar coin in Canada is known as the bimetal coin. In order to accurately detect an outer diameter of such a bimetal coin, a technique of using a ring-shaped outer diameter detection sensor having a space at the central section is known (see Patent Literature 1).

In the ring-shaped outer diameter detection sensor, a core section of the bimetal coin and the space of the outer diameter detection sensor overlap each other, and thus, an electromagnetic field (magnetic flux density) at the core section of the bimetal coin at this time is sufficiently smaller than an electromagnetic field at a ring section. Accordingly, it is possible to detect an outer diameter of the bimetal coin with high accuracy by mainly reflecting influence of the ring section at the outer circumference of the bimetal coin.

CITATION LIST

Patent Literature

Patent Literature 1: Japanese Patent No. 4126668

SUMMARY OF INVENTION

Technical Problem

However, when the above-described conventional outer diameter detection sensor is used, the vicinity of an outer circumference of a small coin (for example, a Canadian ten-cent coin) CO other than the bimetal coin overlaps a space OP1 of an outer diameter detection sensor 4X as illustrated in FIG. 13. Thus, an oscillation frequency and the outer diameter have a relationship that is not proportional in a range RX where the outer diameter of the coin is small as illustrated in FIG. 14. Therefore, there is a possibility of making a mistake in the genuineness determination and type determination without accurately detecting the outer diameter of the small coin.

The present invention has been made in consideration of such points, and an object thereof is to provide a coin processing device that is capable of improving accuracy of detection of each outer diameter of plural types of coins.

Solution to Problem

A coin processing device according to an aspect of the present invention includes: a coin passage through which an inserted coin passes; a material detection sensor which includes a first coil and a second coil facing each other with the coin passage interposed therebetween; an outer diameter detection sensor which includes a ring-shaped third coil that surrounds the first coil and a ring-shaped fourth coil that surrounds the second coil, the third coil and the fourth coil facing each other with the coin passage interposed therebetween; a first oscillation circuit which is connected to the material detection sensor and oscillates a first oscillation signal in an individual connection state, and is connected to the material detection sensor and the outer diameter detection sensor that are connected in series and oscillates the first oscillation signal in a series connection state; a second oscillation circuit which is connected to the outer diameter detection sensor and oscillates a second oscillation signal in the individual connection state; a switching unit which switches the individual connection state and the series connection state; and a coin identification unit which detects an outer diameter of the coin using the second oscillation signal in the individual connection state or the first oscillation signal in the series connection state and identifies the coin based on the outer diameter.

Advantageous Effects of Invention

According to the present invention, it is possible to improve the accuracy in the detection of each outer diameter of plural types of coins.

BRIEF DESCRIPTION OF DRAWINGS

FIG. 1 is a diagram illustrating a part of a schematic configuration of a coin processing device according to an embodiment.

FIG. 2(*a*) is a side view illustrating one side surface of an identification sensor, FIG. 2(*b*) is a side view illustrating another side surface of the identification sensor, and FIG. 2(*c*) is a cross-sectional view of a coin passage and the identification sensor.

FIG. 3 is a block diagram illustrating a configuration which relates to genuineness determination and type determination of the coin processing device of FIG. 1.

FIG. 4 is a circuit diagram illustrating connection of a switching unit in an individual connection state.

FIG. 5 is a circuit diagram illustrating connection of the switching unit in a series connection state.

FIG. 6(*a*) is a view illustrating a positional relationship between a bimetal coin and the identification sensor, FIG.

6(*b*) is a graph illustrating each temporal change of a frequency and a voltage of an outer diameter detection sensor corresponding to FIG. 6(*a*), FIG. 6(*c*) is a view illustrating a positional relationship between a coin other than the bimetal coin and the identification sensor, and FIG. 6(*d*) is a graph illustrating each temporal change of a frequency and a voltage of the outer diameter detection sensor corresponding to FIG. 6(*c*).

FIG. 7(*a*) is a view illustrating a positional relationship between the bimetal coin and the identification sensor, FIG. 7(*b*) is a graph illustrating each temporal change of a frequency and a voltage of a material detection sensor corresponding to FIG. 7(*a*), FIG. 7(*c*) is a view illustrating a positional relationship between the coin other than the bimetal coin and the identification sensor, and FIG. 7(*d*) is a graph illustrating each temporal change of a frequency and a voltage of the material detection sensor corresponding to FIG. 7(*c*).

FIG. 8(*a*) is a view illustrating a positional relationship between the bimetal coin and the identification sensor, FIG. 8(*b*) is a graph illustrating each temporal change of a frequency and a voltage of an outer diameter and material detection sensor corresponding to FIG. 8(*a*), FIG. 8(*c*) is a view illustrating a positional relationship between the coin other than the bimetal coin and the identification sensor, and FIG. 8(*d*) is a graph illustrating each temporal change of a frequency and a voltage of the outer diameter and material detection sensor corresponding to FIG. 8(*c*).

FIG. 9 is a flowchart illustrating a genuineness determination and type determination process of the coin processing device.

FIG. 10 is a graph illustrating a data collection period.

FIG. 11 is a graph illustrating a relationship between the outer diameter of the coin other than the bimetal coin and the frequency detected by the identification unit in the series connection state according to the embodiment.

FIG. 12 is a graph illustrating a relationship between a frequency and a voltage of a coin having a clad structure according to the embodiment.

FIG. 13 is a view illustrating a positional relationship between a conventional outer diameter detection sensor and a small coin.

FIG. 14 is a graph illustrating a relationship between an outer diameter of a coin other than a conventional bimetal coin and a frequency.

DESCRIPTION OF EMBODIMENTS

Hereinafter, an embodiment of the present invention will be described with reference to the drawings. The embodiment does not limit the present invention.

FIG. 1 is a diagram illustrating a part of a schematic configuration of a coin processing device 1 according to an embodiment. As illustrated in FIG. 1, the coin processing device 1 is provided with an insertion opening 2 to which a coin is inserted, a coin passage 3 which is provided to be inclined below the insertion opening 2 and through which the inserted coin passes, and an identification sensor 4 which is provided on a sidewall of the coin passage 3. The sidewall of the coin passage 3 is not illustrated.

The coin inserted from the insertion opening 2 rolls along the coin passage 3 by its own weight and passes through the identification sensor 4. Accordingly, genuineness determination and type determination of the coin is performed as described below.

FIG. 2(*a*) is a side view illustrating one side surface of the identification sensor 4 and FIG. 2(*b*) is a side view illustrating another side surface of the identification sensor 4. FIG. 2(*c*) is a cross-sectional view obtained by cutting the coin passage 3 and the identification sensor 4 of FIG. 1 along a plane which is vertical to a passing direction of a coin CO.

The identification sensor 4 includes a material detection sensor 4*a* and an outer diameter detection sensor 4*b*.

The material detection sensor 4*a* includes a first coil L1 and a second coil L2 which face each other with the coin passage 3 interposed therebetween. The first coil L1 and the second coil L2 are circular and planar coils. That is, the coin can pass through the inside of the material detection sensor 4*a*.

The outer diameter detection sensor 4*b* includes a ring-shaped third coil L3 which surrounds the first coil L1 and a ring-shaped fourth coil L4 which surrounds the second coil L2. The third coil L3 and the fourth coil L4 face each other with the coin passage 3 interposed therebetween. That is, the coin can pass through the inside of the outer diameter detection sensor 4*b*.

In this manner, the outer diameter detection sensor 4*b* is provided in a ring shape to surround the material detection sensor 4*a*.

The first coil L1 and the third coil L3 are spiral coils each of which is provided in a planar shape on a first printed board. The second coil L2 and the fourth coil L4 are spiral coils each of which is provided in a planar shape on a second printed board. It is possible to easily and accurately set relative positions of the material detection sensor 4*a* and the outer diameter detection sensor 4*b* by employing the spiral coil.

FIG. 3 is a block diagram illustrating a configuration which relates to genuineness determination and type determination of the coin processing device 1 of FIG. 1. The coin processing device 1 is provided with a first oscillation circuit 11 which oscillates a first oscillation signal OSC1, a second oscillation circuit 12 which oscillates a second oscillation signal OSC2, envelope detection circuits 13 and 14, a switching unit 15, a coin identification unit 16, and a storage unit (memory) 17.

The first oscillation circuit 11 includes capacitive elements C1 and C2 and an amplifier IC1. One end of the capacitive element C1 is connected to one end of the first coil L1 and an input terminal of the amplifier IC1. The other end of the capacitive element C1 is connected to one end of the capacitive element C2 and is grounded. The other end of the capacitive element C2 is connected to one end of the second coil L2 and an output terminal of the amplifier IC1. A signal of the input terminal of the amplifier IC1 is the first oscillation signal OSC1. A frequency of the first oscillation signal OSC1 in a case where there is no coin is set depending on an inductance connected between the input and output terminals of the amplifier IC1 and capacitance values of the capacitive elements C1 and C2.

The other end of the first coil L1 is connected to a switch S1 of the switching unit 15. The other end of the second coil L2 is connected to a switch S2 of the switching unit 15.

The second oscillation circuit 12 includes capacitive elements C3 and C4 and an amplifier IC2. One end of the capacitive element C3 is connected to a switch S4 of the switching unit 15 and an input terminal of the amplifier IC2. The other end of the capacitive element C3 is connected to one end of the capacitive element C4 and is grounded. The other end of the capacitive element C4 is connected to the switch S3 of the switching unit 15 and an output terminal of the amplifier IC2. The other end of the third coil L3 is connected to the other end of the fourth coil L4. A signal of the input terminal of the amplifier IC2 is the second oscillation signal OSC2. A frequency of the second oscillation signal OSC2 in the case where there is no coin is set depending on an inductance connected between the input and output terminals of the amplifier IC2 and capacitance values of the capacitive elements C3 and C4.

The first oscillation signal OSC1 is supplied to the envelope detection circuit 13 and the coin identification unit 16. The envelope detection circuit 13 performs envelope detection of the first oscillation signal OSC1 and outputs a voltage of the first oscillation signal OSC1.

The second oscillation signal OSC2 is supplied to the envelope detection circuit 14 and the coin identification unit 16. The envelope detection circuit 14 performs envelope detection of the second oscillation signal OSC2 and outputs a voltage of the second oscillation signal OSC2.

The switching unit 15 includes the switches S1 to S4 and performs switching between an individual connection state and a series connection state. In the individual connection state, the first oscillation circuit 11 is connected to the material detection sensor 4*a*, and the second oscillation circuit 12 is connected to the outer diameter detection sensor 4*b*. In the series connection state, the first oscillation circuit 11 is connected to the material detection sensor 4*a* and the outer diameter detection sensor 4*b* which are connected in series, and the second oscillation circuit 12 is not connected to the material detection sensor 4*a* or the outer diameter detection sensor 4*b*.

The coin identification unit 16 includes, for example, an AD converter, a CPU (Central Processing Unit), and the like and detects each frequency of the first oscillation signal OSC1 and the second oscillation signal OSC2. In addition, the coin identification unit 16 controls the switching unit 15.

The storage unit 17 includes, for example, a RAM (Random Access Memory), a non-volatile memory, and the like and stores the voltage and the frequency of the first oscillation signal OSC1 and the voltage and the frequency of the second oscillation signal OSC2 supplied from the coin identification unit 16.

The coin identification unit 16 detects a feature amount (an outer diameter and a material) of a coin based on the first oscillation signal OSC1 and the second oscillation signal OSC2 using values stored in the storage unit 17 and identifies the coin based on the detected feature amount. A specific process will be described later.

FIG. 4 is a circuit diagram illustrating connection of the switching unit 15 in the individual connection state. As illustrated in FIG. 4, the switches S1 and S2 connect the other end of the first coil L1 and the other end of the second coil L2 in the individual connection state. The switch S3 connects one end of the third coil L3 and the output terminal of the amplifier IC2. The switch S4 connects one end of the fourth coil L4 and the input terminal of the amplifier IC2. Accordingly, the first coil L1 and the second coil L2 are connected in series between the input and output terminals of the amplifier IC1, and the third coil L3 and the fourth coil L4 are connected in series between the input and output terminals of the amplifier IC2.

In this manner, the first oscillation circuit 11 is connected to the material detection sensor 4*a* and oscillates the first oscillation signal OSC1 in the individual connection state. The second oscillation circuit 12 is connected to the outer diameter detection sensor 4*b* and oscillates the second oscillation signal OSC2 in the individual connection state.

FIG. 5 is a circuit diagram illustrating connection of the switching unit 15 in the series connection state. As illustrated in FIG. 5, the switches S1 and S3 connect the other end of the first coil L1 and the one end of the third coil L3 in the series connection state. The switches S2 and S4 connect the other end of the second coil L2 and the one end of the fourth coil L4. Accordingly, the first coil L1, the third coil L3, the fourth coil L4, and the second coil L2 are connected in series between the input and output terminals of the amplifier IC1.

In this manner, the first oscillation circuit 11 is connected to the material detection sensor 4*a* and the outer diameter detection sensor 4*b*, which are connected in series, and oscillates the first oscillation signal OSC1 in the series connection state.

Next, a description will be given regarding examples of frequencies and voltages of the respective sensors when the coin passes through the identification sensor 4.

(Outer Diameter Detection Sensor 4*b* in Individual Connection State)

FIG. 6(*a*) is a view illustrating a positional relationship between a bimetal coin BCO and the identification sensor 4, and FIG. 6(*b*) is a graph illustrating each temporal change of a frequency and a voltage of an outer diameter detection sensor 4*b* corresponding to FIG. 6(*a*). The frequency and the voltage of the outer diameter detection sensor 4*b* indicate the frequency and the voltage of the second oscillation signal OSC2 in the individual connection state.

FIG. 6(*c*) is a view illustrating a positional relationship between the coin CO other than the bimetal coin and the identification sensor 4, and FIG. 6(*d*) is a graph illustrating each temporal change of a frequency and a voltage of the outer diameter detection sensor 4*b* corresponding to FIG. 6(*c*).

As illustrated in FIG. 6(*a*), the bimetal coin BCO does not reach the outer diameter detection sensor 4*b* when the bimetal coin BCO is positioned at a point P1. Therefore, the frequency and the voltage of the outer diameter detection sensor 4*b* are substantially the same values as those of a standby state where no coin is inserted as illustrated in FIG. 6(*b*).

An end portion of the bimetal coin BCO reaches an end portion of the outer diameter detection sensor 4*b* at a next point P2. Therefore, the frequency and the voltage of the outer diameter detection sensor 4*b* begin to decrease from the values of the standby state.

The bimetal coin BCO overlaps the entire outer diameter detection sensor 4*b* at a next point P3. The frequency and the voltage of the outer diameter detection sensor 4*b* at this time are the minimum values.

Thereafter, the overlapping area between the bimetal coin BCO and the outer diameter detection sensor 4*b* decreases more and more, and accordingly, the frequency and the voltage of the outer diameter detection sensor 4*b* increase more and more up to the values of the standby state.

As illustrated in FIGS. 6(*c*) and 6(*d*), the frequency and the voltage of the outer diameter detection sensor 4*b* show the same change as that in the case of the bimetal coin BCO when the coin CO other than the bimetal coin is positioned at each of points P1*a*, P2*a* and P3*a*.

(Material Detection Sensor 4*a* in Individual Connection State)

FIG. 7(*a*) is a view illustrating a positional relationship between the bimetal coin BCO and the identification sensor 4, and FIG. 7(*b*) is a graph illustrating each temporal change of a frequency and a voltage of a material detection sensor 4*a* corresponding to FIG. 7(*a*). The frequency and the voltage of the material detection sensor 4*a* indicate the frequency and the voltage of the first oscillation signal OSC1 in the individual connection state.

FIG. 7(*c*) is a view illustrating a positional relationship between the coin CO other than the bimetal coin and the identification sensor 4, and FIG. 7(*d*) is a graph illustrating each temporal change of a frequency and a voltage of the material detection sensor 4*a* corresponding to FIG. 7(*c*).

As illustrated in FIG. 7(*a*), the bimetal coin BCO does not reach the material detection sensor 4*a* when the bimetal coin BCO is positioned at the point P1. Therefore, the frequency and the voltage of the material detection sensor 4*a* are substantially the same values as those of the standby state as illustrated in FIG. 7(*b*).

A ring section BCO1 of the bimetal coin BCO reaches an end portion of the material detection sensor 4*a* at the next point P2. Accordingly, the frequency of the material detection sensor 4*a* changes and the voltage thereof decreases as compared to the values of the standby state.

A core section BCO2 of the bimetal coin BCO reaches the end portion of the material detection sensor 4*a* at the next point P3. Accordingly, the frequency of the material detection sensor 4*a* changes from the value at the point P2, and the voltage thereof increases from the value of the point P2 and then decreases. That is, a voltage waveform has a peak (unevenness) 20 near the point P3.

This is because the bimetal coin BCO uses different materials between the core section BCO2 and the ring section BCO1 so that an electromagnetic field receives different levels of influence between the case where the ring section BCO1 reaches the material detection sensor 4*a* and the case where the core section BCO2 reaches the material detection sensor 4*a*.

The entire material detection sensor 4*a* is overlapped by the core section BCO2 of the bimetal coin BCO at the next point P4. The overlapping area between the bimetal coin BCO and the material detection sensor 4*a* is substantially constant before and after the point P4. The frequency and the voltage of the material detection sensor 4*a* are substantially constant in a range.

Thereafter, when the overlapping area between the bimetal coin BCO and the material detection sensor 4*a* decreases, the frequency and the voltage of the material detection sensor 4*a* increase more and more up to the values of the standby state along with the decrease of the area. A voltage waveform at this time also has a peak.

Meanwhile, when the coin CO other than the bimetal coin reaches the point P2*a*, an end portion of the coin CO reaches the end portion of the material detection sensor 4*a*. Accordingly, the frequency of the material detection sensor 4*a* changes and the voltage thereof decreases as compared to the values of the standby state.

The area of the coin CO overlapping the material detection sensor 4*a* increases at the next point P3*a*. Accordingly, the frequency of the material detection sensor 4*a* changes from the value at the point P2*a*, and the voltage thereof decreases from the value of the point P2*a*.

Thereafter, the frequency and the voltage of the material detection sensor 4*a* are substantially constant in a range where the overlapping area between the coin CO and the material detection sensor 4*a* is substantially constant before and after the point P4*a*.

Thereafter, when the overlapping area between the coin CO and the material detection sensor 4*a* decreases, the frequency and the voltage of the material detection sensor 4*a* increase more and more up to the values of the standby state along with the decrease of the area.

In this manner, the coin CO other than the bimetal coin uses one type of material, and thus, the voltage waveform of the material detection sensor 4*a* does not have the peak.

(Series Connection State)

FIG. 8(*a*) is a view illustrating a positional relationship between the bimetal coin BCO and the identification sensor 4, and FIG. 8(*b*) is a graph illustrating each temporal change of a frequency and a voltage of an outer diameter and material detection sensor corresponding to FIG. 8(*a*). The outer diameter and material detection sensor indicates the outer diameter detection sensor 4*b* and the material detection sensor 4*a* which are connected in series. The frequency and the voltage of the outer diameter and material detection sensor indicate the frequency and the voltage of the first oscillation signal OSC1 in the series connection state.

FIG. 8(*c*) is a view illustrating a positional relationship between the coin CO other than the bimetal coin and the identification sensor 4, and FIG. 8(*d*) is a graph illustrating each temporal change of a frequency and a voltage of the outer diameter and material detection sensor corresponding to FIG. 8(*c*).

When the bimetal coin BCO is positioned at the point P1 as illustrated in FIG. 8(*a*), the frequency and the voltage of the outer diameter and material detection sensor are substantially the same values as those in the standby state where no coin is inserted as illustrated in FIG. 8(*b*).

The end portion of the bimetal coin BCO reaches the end portion of the outer diameter detection sensor 4*b* at the next point P2. Therefore, the frequency and the voltage of the outer diameter and material detection sensor decrease from the values of the standby state.

The core section BCO2 of the bimetal coin BCO reaches the end portion of the material detection sensor 4*a* at the next point P3. Accordingly, the frequency and the voltage of the outer diameter and material detection sensor decrease from the values at the point P2.

The entire material detection sensor 4*a* is overlapped by the core section BCO2 of the bimetal coin BCO at the next point P4. The frequency and the voltage of the outer diameter detection sensor 4*b* at this time are the minimum values.

Thereafter, the overlapping area between the bimetal coin BCO and the outer diameter and material detection sensor decreases more and more, and accordingly, the frequency and the voltage of the outer diameter and material detection sensor increase more and more up to the values of the standby state.

As illustrated in FIGS. 8(*c*) and 8(*d*), the frequency of the outer diameter and material detection sensor changes, and the voltage thereof decreases more and more when the position of the coin CO other than the bimetal coin changes from the point Pla to P2*a* and P3*a*. The overlapping area between the coin CO and the outer diameter and material detection sensor are constant at the points P3*a* and P4*a*, the frequency and the voltage of the outer diameter and material detection sensor are constant.

Next, a genuineness determination and type determination process will be described with reference to FIGS. 9 and 10.

FIG. 9 is a flowchart illustrating the genuineness determination and type determination process of the coin processing device 1. The process of FIG. 9 is performed by control of the coin identification unit 16. FIG. 10 is a graph illustrating a data collection period and corresponds to the above-described FIGS. 6(*b*) and 6(*d*).

First, the individual connection state is set after turning on power (Step S1).

Next, a voltage of the outer diameter detection sensor 4*b* (a standby voltage Vs in FIG. 10) is stored in the storage unit 17 (Step S2).

Next, the voltage of the outer diameter detection sensor 4*b* is measured (Step S3).

Next, when the voltage of the outer diameter detection sensor 4*b* has not changed to 80% of the standby voltage Vs (No in Step S4), the process returns to the processing in Step S3 since the coin does not reach near the outer diameter detection sensor 4*b*.

When the voltage of the outer diameter detection sensor 4*b* has changed to 80% of the standby voltage Vs (Yes in Step S4, time t1 in FIG. 10), the voltage and the frequency of the outer diameter detection sensor 4*b* are stored in the storage unit 17 since the coin reaches near the outer diameter detection sensor 4*b* (Step S5). This time t1 becomes a data collection start point.

Next, the voltage and the frequency of the material detection sensor 4*a* are stored in the storage unit 17 (Step S6).

Next, the state is switched to the series connection state (Step S7).

Next, the voltage and the frequency of the outer diameter and material detection sensory are stored in the storage unit 17 (Step S8).

Next, the state is switched to the individual connection state (Step S9).

Next, when the voltage of the outer diameter detection sensor 4*b* has not returned to 85% of the standby voltage Vs (No in Step S10), the process returns to the processing in Step S5. In this manner, the switching unit 15 alternately switches the individual connection state and the series connection state.

When the voltage of the outer diameter detection sensor 4*b* has returned to 85% of the standby voltage Vs (Yes in Step S10, time t2 in FIG. 7), whether the coin is the bimetal coin is determined based on the voltage waveform of the material detection sensor 4*a* stored in the storage unit 17 (Step S11). That is, the time t2 in FIG. 7 becomes a data collection end point, and a period between the time t1 and t2 becomes the data collection period.

In the present embodiment, for example, the coin identification unit 16 determines whether the coin is the bimetal coin depending on the voltage of the first oscillation signal OSC1 in the individual connection state during passing of the coin through a portion (the material detection sensor 4*a*) between the first coil L1 and the second coil L2, and either the second oscillation signal OSC2 in the individual connection state or the first oscillation signal OSC1 in the series connection state is selected. That is, whether the coin is bimetal coin is determined using the above-described difference in the voltage waveform of the material detection sensor 4*a* (FIGS. 7(*b*) and 7(*d*)).

To be specific, the coin identification unit 16 determines that a coin is the bimetal coin when the peak is present in the voltage waveform of the first oscillation signal OSC1 in a determination period set in advance during the passing of the coin through the portion between the first coil L1 and the second coil L2, and selects the second oscillation signal OSC2 in the individual connection state.

In addition, the coin identification unit 16 determines that a coin is the coin other than the bimetal coin when there is no peak in the voltage waveform of the first oscillation signal OSC1 in the above-described determination period and selects the first oscillation signal OSC1 in the series connection state.

The determination period is a period from the point P1 to the point P3 of FIG. 7(*b*) and a period of FIG. 7(*d*) which corresponding thereto, for example.

When the coin is the bimetal coin (Yes in Step S11), the outer diameter is detected using the frequency of the outer diameter detection sensor 4*b* (the selected second oscillation signal OSC2) stored in the storage unit 17, and the coin is identified based on the outer diameter (Step S12). For example, the outer diameter may be determined depending on a comparison result obtained by comparing the minimum value of the frequency and a frequency determination threshold value.

Next, the material is detected using the voltage of the outer diameter detection sensor 4*b*, the frequency and the voltage of the material detection sensor 4*a*, and the voltage of the outer diameter and material detection sensor stored in the storage unit 17, and the coin is identified based on the material (Step S13). For example, the material may be detected using comparison results obtained by comparing the minimum value of the voltage and a voltage determination threshold value and comparing the minimum value of the frequency and the frequency determination threshold value. The voltage determination threshold value and the frequency determination threshold value are stored in the storage unit 17 in advance.

Incidentally, the material may be detected in Step S13 using at least any of the voltage of the outer diameter detection sensor 4*b*, the frequency of the material detection sensor 4*a*, the voltage of the material detection sensor 4*a*, and the voltage of the outer diameter and material detection sensor.

On the other hand, when the coin is not the bimetal coin (No in Step S11), the outer diameter is detected using the frequency of the outer diameter and material detection sensor (the selected first oscillation signal OSC1) stored in the storage unit 17, and the coin is identified based on the outer diameter (Step S14). For example, the outer diameter may be determined depending on the comparison result obtained by comparing the frequency minimum value and determination threshold value.

Next, the material is detected using the voltage of the outer diameter detection sensor 4*b*, the frequency and the voltage of the material detection sensor 4*a*, and the voltage of the outer diameter and material detection sensor stored in the storage unit 17, and the coin is identified based on the material (Step S15). For example, the material may be detected using comparison results obtained by comparing the minimum value of the voltage and the voltage determination threshold value and comparing the minimum value of the frequency and the frequency determination threshold value.

Incidentally, the material may be detected in Step S15 using at least any of the voltage of the outer diameter detection sensor 4*b*, the frequency of the material detection sensor 4*a*, the voltage of the material detection sensor 4*a*, and the voltage of the outer diameter and material detection sensor.

In this manner, the coin identification unit 16 detects the outer diameter of the coin using the second oscillation signal OSC2 in the individual connection state or the first oscillation signal OSC1 in the series connection state.

In addition, the coin identification unit 16 detects the material of the coin using at least any of the first oscillation signal OSC1 in the individual connection state, the second oscillation signal OSC2 in the individual connection state, and the first oscillation signal OSC1 in the series connection state.

FIG. 11 is a graph illustrating a relationship between the outer diameter of the coin other than the bimetal coin and the frequency detected by the coin identification unit 16 in the series connection state according to the embodiment. Since the entire coin is affected by the electromagnetic field regardless of the outer diameter in the series connection state, the frequency to be detected by the coin identification unit 16 decreases in proportional to a size of the outer diameter as illustrated in FIG. 11. Therefore, it is possible to detect the outer diameter with high accuracy even if the coin is small.

FIG. 12 is a graph illustrating a relationship between a frequency and a voltage of a coin having a clad structure according to the embodiment. The frequency of the material detection sensor 4*a* in the individual connection state is denoted by Forg, and the frequency thereof in the series connection state is denoted by Flow. The inductance in the series connection state becomes larger than the inductance of the material detection sensor 4*a*, and thus, the frequency Flow is lower than the frequency Forg in the state where there is no coin.

In this manner, it is possible to detect the material at two skin depths using the two frequencies Forg and Flow. Therefore, it is possible to detect the material for each layer with respect to a coin such as a plated coin or a clad coin, which is configured using a multi-layer member, other than the bimetal coin. Accordingly, it is possible to improve the detection accuracy of the material.

In the example of FIG. 12, a material of a test coin having the clad structure, which has a core material and a surface layer material covering the core material, is detected. In the case of the frequency Forg, the electromagnetic field is mainly affected by the surface layer material, and thus, the surface layer material can be detected. In the case of the frequency Flow, the electromagnetic field is mainly affected by the core material, and thus, the core material can be detected. In this example, the frequency Flow is substantially equal to the frequency Forg due to the influence of the coin.

As illustrated in FIG. 12, the voltage becomes high in the case of the frequency Forg in the individual connection state, and the voltage becomes low in the case of the frequency Flow in the series connection state. In this manner, the voltages different from each other between the two connection states are obtained, and thus, it is possible to detect that the coin has the core material and the surface layer material made of the materials different from each other.

Although not illustrated, it is possible to detect a material for each layer of the multi-layer member using three frequencies when the voltage of the outer diameter detection sensor 4*b*, the frequency and the voltage of the material detection sensor 4*a*, and the voltage of the outer diameter and material detection sensor are used as described above.

In this manner, whether the coin is bimetal coin is detected depending on whether the peak is present in the voltage waveform of the material detection sensor 4*a* during the passing of the coin serving as a detection target by providing the material detection sensor 4*a* and the ring-shaped outer diameter detection sensor 4*b* that surrounds the material detection sensor 4*a* according to the present embodiment.

Further, when the coin is determined as the coin other than the bimetal coin, it is configured such that the outer diameter is detected using the frequency of the outer diameter and material detection sensor obtained by connecting the material detection sensor 4*a* and the outer diameter detection sensor 4*b* in series. Accordingly, the entire surface of the coin is affected by the electromagnetic field from the material detection sensor 4*a* and the outer diameter detection sensor 4*b* even if the coin has a small outer diameter. Accordingly, the outer diameter and the frequency are proportional to each other regardless of the outer diameter, and thus, it is possible to detect the outer diameter with high accuracy.

On the other hand, when the coin is determined as the bimetal coin, the outer diameter is detected using the frequency of the ring-shaped outer diameter detection sensor 4*b*, and thus, it is possible to detect the outer diameter with high accuracy by reflecting the ring section at the outer circumference of the bimetal coin.

Therefore, it is possible to improve the detection accuracy of the outer diameter of plural types of coins.

In addition, it is configured such that the material is detected using the voltage of the outer diameter detection sensor 4*b*, the frequency and the voltage of the material detection sensor 4*a*, and the voltage of the outer diameter and material detection sensor regardless of the type of the coin.

Accordingly, it is possible to use the three types of frequencies, and thus, the information that can be obtained increases. That is, a depth that the electromagnetic field reaches differs depending on a frequency, and thus, a material on a surface and a material of an inner portion can be distinguished and detected depending on the frequency even in the case of the clad coin or the plated coin configured using the multi-layer member.

Therefore, it is possible to improve the detection accuracy of the material of plural types of coins.

Incidentally, the first coil L1 to the fourth coil L4 may be formed by winding a conducting wire around a core such as a ferrite material.

In addition, the description has been given regarding the example where the voltage and the frequency are stored by alternately switching the individual connection state and the series connection state and whether the coin is the bimetal coin is determined after the data collection period ends, but the invention is not limited thereto. For example, whether the coin is the bimetal coin may be determined at substantially the same timing as the point P3 in FIG. 7(*b*), and thereafter, the outer diameter and the material may be determined using a voltage and a frequency thus obtained by fixing the state to any one of the individual connection state and the series connection state depending on a result of the determination.

Although several embodiments of the present invention have been described as above, the embodiments are given as examples and have no intention to limit the scope of the invention. These embodiments can be implemented in various other modes, and various omissions, substitutions, and alterations can be made within a scope without departing from a gist of the invention. The accompanying claims and their equivalents are intended to cover these embodiments and modifications thereof as would fall within the scope and the gist of the invention.

REFERENCE SIGNS LIST

1 coin processing device
2 insertion opening
3 coin passage
4 identification sensor
4*a* material detection sensor
4*b* outer diameter detection sensor
L1 first coil
L2 second coil
L3 third coil
L4 fourth coil

11 first oscillation circuit
12 second oscillation circuit
13, 14 envelope detection circuit
15 switching unit
16 coin identification unit
17 storage unit

The invention claimed is:

1. A coin processing device comprising:

a coin passage through which an inserted coin passes;

a material detection sensor which includes a first coil and a second coil facing each other with the coin passage interposed therebetween;

an outer diameter detection sensor which includes a ring-shaped third coil that surrounds the first coil and a ring-shaped fourth coil that surrounds the second coil, the third coil and the fourth coil facing each other with the coin passage interposed therebetween;

a first oscillation circuit which is connected to the material detection sensor and oscillates a first oscillation signal in an individual connection state, and is connected to the material detection sensor and the outer diameter detection sensor that are connected in series and oscillates the first oscillation signal in a series connection state;

a second oscillation circuit which is connected to the outer diameter detection sensor and oscillates a second oscillation signal in the individual connection state;

a switching unit which switches the individual connection state and the series connection state; and a coin identification unit which detects an outer diameter of the coin using the second oscillation signal in the individual connection state or the first oscillation signal in the series connection state and identifies the coin based on the outer diameter.

2. The coin processing device according to claim 1, wherein the coin identification unit selects any of the second oscillation signal in the individual connection state and the first oscillation signal in the series connection state depending on the first oscillation signal in the individual connection state during passing of the coin through a portion between the first coil and the second coil, and detects the outer diameter of the coin using the selected first oscillation signal or second oscillation signal.

3. The coin processing device according to claim 2, wherein the coin identification unit selects the second oscillation signal in the individual connection state when a peak is present in a voltage waveform of the first oscillation signal in a determination period set in advance during passing of the coin through a portion between the first coil and the second coil, and selects the first oscillation signal in the series connection state when there is no peak in the voltage waveform of the first oscillation signal in the determination period.

4. The coin processing device according to claim 1, wherein the coin identification unit detects a material of the coin using the first oscillation signal in the individual connection state and identifies the coin based on the material and the outer diameter.

5. The coin processing device according to claim 4, wherein the coin identification unit detects the material of the coin using the first oscillation signal in the individual connection state and the first oscillation signal in the series connection state.

6. The coin processing device according to claim 1, further comprising a storage unit which stores a voltage and a frequency of the first oscillation signal and a voltage and a frequency of the second oscillation signal, wherein the switching unit alternately switches the individual connection state and the series connection state, and the coin identification unit identifies the coin using a value stored in the storage unit.

7. The coin processing device according to claim 1, wherein the first coil and the third coil are spiral coils each of which is provided on a first substrate in a planar shape, and the second coil and the fourth coil are spiral coils each of which is provided on a second substrate in a planar shape.

* * * * *